US008839996B2

(12) United States Patent
Parazynski et al.

(10) Patent No.: US 8,839,996 B2
(45) Date of Patent: Sep. 23, 2014

(54) APPARATUS AND METHODS FOR FLUID STORAGE AND DELIVERY

(75) Inventors: Scott E. Parazynski, Houston, TX (US); Grant C. Bue, Houston, TX (US); Mark E. Schaefbauer, League City, TX (US); Kase C. Urban, League City, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 1236 days.

(21) Appl. No.: 12/612,171

(22) Filed: Nov. 4, 2009

(65) Prior Publication Data

US 2011/0101050 A1 May 5, 2011

(51) Int. Cl.

| | |
|---|---|
| ***A45F 3/16*** | (2006.01) |
| ***A45F 5/00*** | (2006.01) |
| ***A45F 3/04*** | (2006.01) |

(52) U.S. Cl.

CPC .... *A45F 3/16* (2013.01); *A45F 3/04* (2013.01)
USPC ..... 224/148.2; 224/148.3; 224/148.4

(58) Field of Classification Search

USPC ..... 224/148.2, 148.4, 148.3
See application file for complete search history.

(56) References Cited

U.S. PATENT DOCUMENTS

| | | | | |
|---|---|---|---|---|
| 4,090,650 | A * | 5/1978 | Gotta | 224/148.2 |
| 4,196,817 | A * | 4/1980 | Moser | 215/12.1 |
| 4,420,097 | A * | 12/1983 | Motsenbocker | 222/131 |
| 4,544,087 | A | 10/1985 | Modig | |
| 4,948,023 | A * | 8/1990 | Tripp | 224/148.2 |
| 4,998,415 | A * | 3/1991 | Larsen | 62/231 |
| 5,060,833 | A * | 10/1991 | Edison et al. | 224/148.2 |
| 5,085,349 | A * | 2/1992 | Fawcett | 220/703 |
| 5,115,947 | A * | 5/1992 | McDonnell et al. | 222/107 |
| 5,221,016 | A * | 6/1993 | Karpal | 215/12.2 |
| 5,864,880 | A * | 2/1999 | Adam | 2/94 |
| 5,940,880 | A * | 8/1999 | Phillips | 2/7 |
| 6,220,490 | B1 * | 4/2001 | O'Hara | 224/148.2 |
| 6,422,300 | B1 | 7/2002 | Wylin | |
| 6,497,348 | B2 * | 12/2002 | Forsman et al. | 224/148.2 |
| 6,651,694 | B1 | 11/2003 | Krenzel et al. | |
| 6,820,780 | B2 | 11/2004 | Forsman et al. | |
| 6,870,135 | B2 * | 3/2005 | Hamm et al. | 219/386 |
| 6,997,181 | B2 | 2/2006 | Fletcher | |
| 7,063,243 | B2 | 6/2006 | Forsman et al. | |
| 7,311,231 | B2 | 12/2007 | Noell et al. | |
| 7,392,916 | B1 * | 7/2008 | Kuighadush | 220/707 |
| 7,464,837 | B2 * | 12/2008 | Hoskins | 222/175 |

(Continued)

*Primary Examiner* — Adam Waggenspack
*Assistant Examiner* — Lester L Vanterpool
(74) *Attorney, Agent, or Firm* — Kurt G. Hammerle

(57) ABSTRACT

An apparatus and method for storing and delivering fluid to a person comprises, in at least one specific embodiment, a fluid reservoir having an internal volume therein with an opening disposed through a first wall or a second wall of the fluid reservoir and located toward a first end of the fluid reservoir. A first portion of a tube can be exterior to the fluid reservoir and a second portion of the tube can be disposed through the opening and within the internal volume. At least one insulation layer can be disposed about the exterior of the first wall of the fluid reservoir. The second wall of the fluid reservoir can be configured for transferring heat from or to the internal volume or from the person. At least one baffle is disposed within the internal volume and connected to the first wall and the second wall of the fluid reservoir.

32 Claims, 5 Drawing Sheets

(56) References Cited

U.S. PATENT DOCUMENTS

| | | | | |
|---|---|---|---|---|
| 8,136,702 | B2 * | 3/2012 | Skillern et al. | 222/209 |
| 2002/0113101 | A1 * | 8/2002 | Skillern | 224/148.2 |
| 2003/0127475 | A1 * | 7/2003 | Manini | 224/148.2 |
| 2004/0178235 | A1 * | 9/2004 | Forsman et al. | 224/148.2 |
| 2005/0029319 | A1 * | 2/2005 | Robins et al. | 224/148.2 |
| 2006/0144862 | A1 | 7/2006 | Reichert et al. | |
| 2006/0151534 | A1 * | 7/2006 | Mares | 222/175 |
| 2006/0191049 | A1 * | 8/2006 | Elkins et al. | 2/7 |
| 2006/0283205 | A1 * | 12/2006 | Carriere | 62/457.2 |
| 2007/0012732 | A1 | 1/2007 | Adams | |
| 2007/0181616 | A9 * | 8/2007 | Horito et al. | 224/148.2 |
| 2008/0185408 | A1 * | 8/2008 | James | 224/148.2 |
| 2008/0308578 | A1 | 12/2008 | Skillern et al. | |
| 2010/0044396 | A1 * | 2/2010 | Skillern | 222/209 |

* cited by examiner

APPARATUS AND METHODS FOR FLUID STORAGE AND DELIVERY

ORIGIN OF THE INVENTION

The invention described herein was made in part by employees of the United States Government and in part was made in the performance of work under a NASA contract subject to the provisions of Section 305 of the National Aeronautics and Space Act of 1958, Public Law 85-568 (72 Stat. 435; 42 U.S.C. 2457). The invention may be manufactured and used by and for the Government of the United States for governmental purposes without the payment of any royalties thereon or therefor.

BACKGROUND OF THE INVENTION

1. Field of the Invention

Embodiments of the present invention generally relate to apparatus and methods for the storage and delivery of a fluid. More particularly, embodiments of the present invention relate to apparatus and methods for the storage and delivery of a fluid in a cold environment.

2. Description of the Related Art

Typical fluid storage containers of the related art, especially for outdoor activities, such as hiking, biking, running, and mountain climbing, include a bag-like fluid reservoir that is carried in a back or waist-mounted pack. A long flexible straw is connected to the storage container that terminates at a mouthpiece from which a user can drink fluid therefrom.

Current fluid storage systems suffer from several drawbacks, especially when exposed to cold environments. A common problem that occurs with such related fluid storage systems is that water or other liquid within the reservoir itself and especially within the tube tends to freeze in cold environments. As the user draws fluid from the reservoir through the tube, the liquid begins to freeze therein. After a sufficient period of time or number of fluid removal cycles, the particles of the frozen liquid will sufficiently accumulate and completely obstruct the flow of fluid from the reservoir via the tube to the thirsty user. Further, if the fluid storage system is exposed to a cold environment for a sufficiently long enough period of time, such as during a mountain climbing, expedition, the fluid within the reservoir also freezes.

SUMMARY OF THE INVENTION

Apparatus and methods for storing and delivering fluid to a person are provided. In at least one specific embodiment, the apparatus can include a fluid reservoir having an internal volume therein. An opening can be disposed through a first wall or a second wall of the fluid reservoir and located toward a first end of the fluid reservoir. A first portion of a tube can be exterior to the fluid reservoir and a second portion of the tube can be disposed through the opening and within the internal volume. At least one insulation layer can be disposed about the exterior of the first wall of the fluid reservoir. A second wall of the fluid reservoir can be configured to transfer heat to or from the internal volume. At least one baffle can be disposed within the internal volume and connected to the first wall and the second wall of the fluid reservoir.

In at least one other specific embodiment, the apparatus for storing and delivering fluid to a person can include a flexible fluid reservoir having an internal volume therein. An opening can be disposed through a first wall or a second wall of the fluid reservoir and located toward a first end of the fluid reservoir. A first portion of a tube can be exterior to the fluid reservoir and a second portion of the tube can be disposed through the opening and within the internal volume. At least one insulation layer can be disposed about the exterior of the first wall of the fluid reservoir. A second wall of the fluid reservoir can be configured to transfer heat to or from the internal volume. At least one pair of baffles can be disposed within the internal volume and connected to the first wall and the second wall. The second portion of the tube can be positioned such that a portion of the second portion extends in substantially the same longitudinal direction as the at least one pair of baffles and a portion of the second portion traverses through an opening disposed through the at least one pair of baffles.

In at least one specific embodiment, the method for storing and delivering fluid to a person can include introducing a fluid to an internal volume of a hydration system. The hydration system can be located about a person. The hydration system can include a fluid reservoir having the internal volume therein. An opening can be disposed through a first wall or a second wall of the fluid reservoir and located toward a first end of the fluid reservoir. A first portion of a tube can be exterior to the fluid reservoir and a second portion of the tube can be disposed through the opening and positioned within the internal volume. At least one insulation layer can be disposed about the exterior of the first wall of the fluid reservoir. The second wall of the fluid reservoir can be configured to transfer heat to or from the internal volume, collect heat from an external source, or both. At least one baffle can be disposed within the internal volume and connected to the first wall and the second wall of the fluid reservoir. The second wall can be proximal to the person and the first wall can be distal to the person. Heat can be collected from the person over a surface area of the second wall. At least a portion of the collected heat can be transferred to at least one of the first portion of the tube and the internal volume.

In another exemplary embodiment, a hydration system is provided which comprises means for storing a fluid. The means for storing comprises a first flexible wall and a second flexible wall operatively connected to one another so as to provide an internal volume therein, such as a bag, bladder, or other flexible container. The means for storing further comprises at least one pair of baffles, each baffle being disposed within the internal volume and connected to an interior surface of the first flexible wall and an interior surface of the second flexible wall. The means for storing includes an opening disposed through the first flexible wall or the second flexible wall. The means for storing is configured in shape and size such that the second flexible wall readily transfers body heat from a person using the hydration system to the internal volume. The hydration system further comprises means for conveying fluid, such as a straw or tube, stored within the internal volume. A first portion of the means for conveying can be exterior to the means for storing and a second portion of the means for conveying can be disposed through the opening disposed through the first flexible wall or the second flexible wall and within the internal volume. The hydration system can further comprise means for insulating, the means for storing. The insulating means can be disposed about an exterior surface of the first flexible wall. The hydration system can further comprise means for supporting the means for storing in a position about an upper torso of the person using the hydration system. The means for supporting comprises means for snuggling the means for storing in close proximity to or near the upper torso of the person using the hydration system.

BRIEF DESCRIPTION OF THE DRAWINGS

So that the manner in which the above recited features of the invention can be understood in detail, a more particular description of the exemplary embodiments, briefly summarized above, may be had by reference to the Detailed Description and by illustration in the appended drawings. The appended drawings illustrate only exemplary embodiments of the invention and are therefore not to be considered limiting of its scope, for the invention may admit to other equivalent embodiments.

DETAILED DESCRIPTION

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions.

Figure 1:
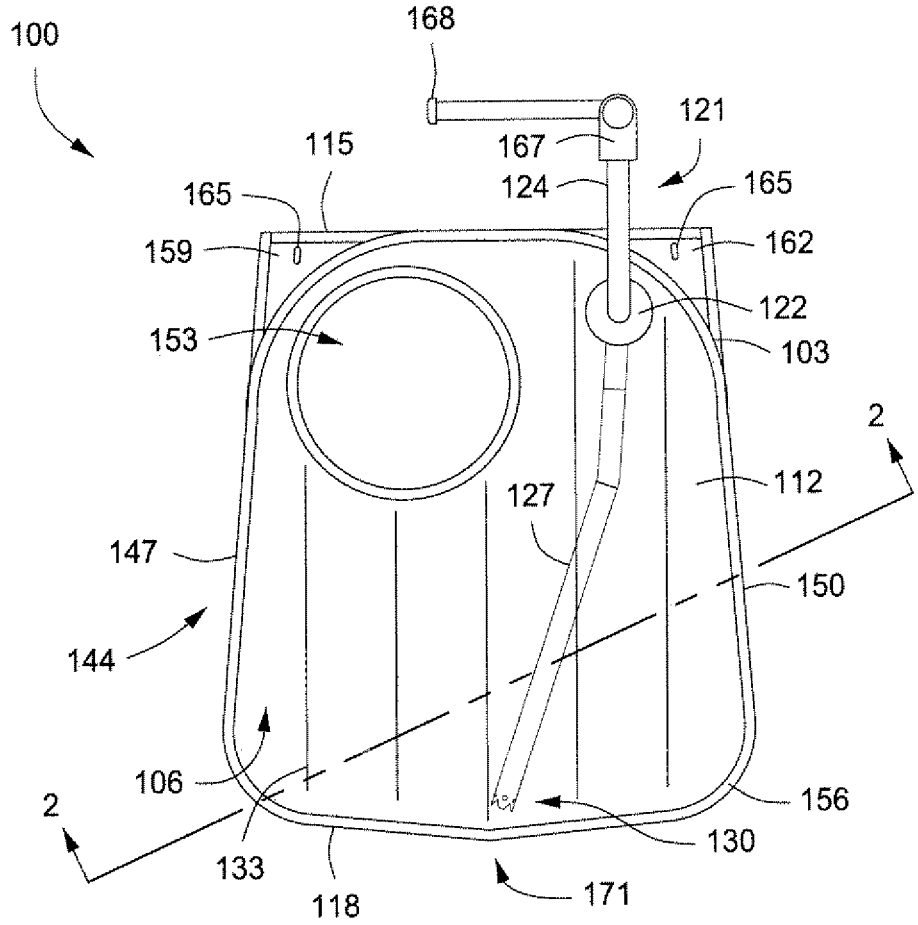
FIG. 1 depicts a schematic of an illustrative hydration system, according to one or more embodiments described.

FIG. 1 depicts a schematic of an illustrative hydration system 100, according to one or more embodiments. The hydration system 100 comprises a fluid reservoir 103 having an internal volume 106 disposed within the fluid reservoir 103. The hydration system 100 can include a tube or conduit 121 in fluid communication with the internal volume 106. The tube can provide a means for conveying a fluid from the internal volume 106 to the exterior thereof. The tube 121 can include a first or "external" portion 124 exterior to the fluid reservoir 103 and a second or "internal" portion 127 disposed through an opening (not shown) and within the internal volume 106. The tube 121 can be disposed through a first or "front" wall 112 or a second or "rear" wall 144 of the fluid reservoir 103. At least one baffle (five are shown as part 133 in FIGS. 1 and 2) can be disposed within the internal volume 106 of the fluid reservoir 103. The baffles 133 can be operatively connected within the internal volume 106 to the front wall 112 and/or the rear wall 144. The hydration system 100 can include a sealable port ("fill port") 153 to allow a fluid to be introduced to the internal volume 106. As used herein, the terms "top" and "bottom," "front" and "rear," "left" and "right," and other like terms are merely used for convenience to depict spatial orientations or spatial relationships relative to one another in respect to the hydration system 100 when viewed from the direction shown in FIG. 1.

In one or more embodiments, the fluid reservoir 103 can be made from a plurality of flexible sheets of material. As illustrated the fluid reservoir 103 can be made from a first sheet of flexible material, which forms the front wall 112 and a second sheet of flexible material, which forms the rear wall 144. The front wall 112 and the rear wall 144 can be connected together, such that the internal volume 106 is formed between the front wall 112 and the rear wall 144. As illustrated, the front wall 112 and the rear wall 144 can be welded or otherwise operatively connected together to provide a fluid tight seam 156 therebetween and about a perimeter of the internal volume 106. The front wall 112 and the rear wall 144 can be welded together using any suitable device, for example radio frequency ("RF") welding, direct heat, or the like. Other illustrative systems, devices, or methods for connecting the front wall 112 to the rear wall 144 can include, but are not limited to, adhesives, stitching, rivets, or combinations thereof. In at least one specific embodiment, the fluid reservoir 103 can be formed as a seamless integral fluid reservoir, such as a balloon. A fluid reservoir 103 formed as a seamless integral fluid reservoir can be configured to have the front wall 112 and the rear wall 144.

The fluid reservoir 103 can vary in shape and size depending on the volume of fluid to be disposed within the internal volume 106, the shape and size of a pack 705 (see FIGS. 7 and 8) or other storage container the hydration system 100 may be disposed in, the size of a torso of a user that may carry the hydration system 100, or any combination thereof. In one or more embodiments, the internal volume 106 can have a volume ranging from a low of about 0.5 Liter ("L"), to a high of about 5 L. In one or more embodiments, the internal volume 106 can have a volume of about 2.5 L, about 3 L, about 3.5 L, about 4 L, or about 5 L.

The shape and size of the fluid reservoir 103 can also be configured by considering the ratio of the total internal volume 106 compared to the total surface area of the fluid reservoir or of the surface area of the fluid reservoir placed in proximate or close spatial relationship or in contact with the torso of the user, which would be a numeric value given in units cubed per units squared. The total surface area of the fluid reservoir 103 includes the surface area of the front wall 112 and the rear wall 144. The shape of the fluid reservoir 103 can be configured such that the surface area of the fluid reservoir placed in proximate contact with the torso of the user is a significant portion of the total surface area of the fluid reservoir. For example, the internal volume 106 can have a volume ranging from about 500 $cm^3$ (0.5 L) to about 5,000 $cm^3$ (5 L). The surface area of the fluid reservoir in proximate contact with the torso can have a value such that the internal volume 106 has a ratio of about 0.5 $cm^3$ per square centimeter of surface area in proximate contact with the torso, about 1 $cm^3$ per square centimeter of surface area in proximate contact with the torso, about 2 $cm^3$ per square centimeter of surface area in proximate contact with the torso, about 4 $cm^3$ per square centimeter of surface area in proximate contact with the torso, or about 6 $cm^3$ per square centimeter of surface area in proximate contact with the torso. As will be described in more detail below, because the rear wall 144 can be non-insulated, an important surface for design of the size and shape of the reservoir is the non-insulated interface between the reservoir 103 and the torso of the user. In at least one specific embodiment, the interior volume can be about 3,000 $cm^3$ and the surface area of the rear wall 144 can be about 500 $cm^2$, i.e. a ratio of about 6 $cm^3$ per $cm^2$.

The front wall 112 and the rear wall 144 can be waterproof, i.e. the front wall 112 and the rear wall 144 can prevent water or other fluids from passing therethrough. In one embodiment, the front wall 112 and the rear wall 144 may be constructed of translucent material so as to enable the user of the hydration system to see the amount of fluid contained within the internal volume 106 of the fluid reservoir 103. The front wall 112 and/or the rear wall 144 can be made from the same or different materials. Illustrative materials can include, but are not limited to, polymers, rubbers, metal foils, and combinations thereof. The polymers can include, but are not limited to, butylene polymer, ethylene polymer, high density polyethylene ("HDPE") polymer, medium density polyethylene ("MDPE") polymer, low density polyethylene ("LDPE") polymer, very low density polyethylene ("VLDPE"); propylene ("PP") polymer, isotactic polypropylene ("iPP") polymer, high crystallinity polypropylene ("HCPP") polymer, ethylene-propylene ("EP") copolymers, ethylene-propylene-butylene ("EPB") terpolymers, propylene-butylene ("PB") copolymer, an ethylene elastomer, an ethylene-based plastomer, a propylene elastomer, polyurethane, and combinations or blends thereof. In one or more embodiments, the front wall 112 and/or the rear wall 144 can have a thickness ranging from a low of about 0.05 mm, about 0.1 mm, or about 0.15 mm to a high of about 0.5 mm, about 1 mm, or about 10 mm.

The fluid reservoir 103 can include one or more tab portions (two are shown 159, 162) disposed thereon. The tab portions 159, 162 can be an extension of the front wall 112 and the rear wall 144 that lies outside the perimeter of the weld seam 156. The tab portions 159, 162 can provide a convenient location for gripping the hydration system 100 and/or for securing the hydration system 100 to a pack or other support device. The tab portions 159, 162 can include one or more slots, grooves, holes, or other openings 165 disposed therethrough. The opening 165 can receive a securing mechanism such as a button, loop, or equivalent fastener from a support pack, a person's finger(s), a hanging/storage hook, or the like. The tab portions 159, 162 can be reinforced with any suitable material to prevent or otherwise reduce the potential for tearing or ripping the tab portions 159, 162. Illustrative reinforcement materials can include, but are not limited to, flexible materials such as fabrics, metal foils or sheets, or the like; rigid materials such as fiberglass, carbon fiber, wood, rigid polymeric material, or the like. For example, the tab portions 159, 162 can be reinforced with nylon fabric.

The opening through which the tube 121 can pass can be disposed through the front wall 112 of the fluid reservoir 103 between a first or "top" side 115 and a second or "bottom" side 118 of the fluid reservoir 103. The opening can be disposed closer to the top side 115 than the bottom side 118. In at least one specific embodiment, the opening can be disposed through the rear wall 144. The opening disposed through the rear wall 144 can be disposed closer to the top side 115 than the bottom side 118. The opening can be sized to accommodate the tube 121 disposed therethrough. Although not shown, the opening can be sized to accommodate one or more tubes, in addition to the tube 121, disposed therethrough, for example a vent tube. The tube 121 can include a connecting member, e.g. a collar or coupler, 122 or other suitable connecting member that can be connected to the front wall 112 about the opening. In at least one specific embodiment, the connecting member 122 can be disposed within the opening and secured thereto. The connecting member 122 can be secured to the front wall 112 using any suitable fastening device or method, such as welding, adhesives, rivets, stitching, or combinations thereof. The tube 121 can be disposed through the collar 122 or connected to the collar 122. For example, the external portion 124 of the tube 121 can be connected to the collar 122 on the side exterior the internal volume 106 and the internal portion 127 of the tube 121 can be connected to the collar 122 on the side internal the internal volume 106.

The first or external portion 124 of the tube 121 can extend from the opening toward the top side 115 of the fluid reservoir 103. The external portion 124 can include a valve 167 or other device suitable for restricting the flow of a fluid through the tube 121. The valve 167 can be any suitable type of valve, for example a check valve. In at least one specific embodiment, the valve 167 can include a rotatable valve assembly that includes a core body having an inlet and outlet port for connecting to the tube 121. In another embodiment, a bite valve or mouth piece 168 can be disposed on a distal end of the external portion 124 of the tube 121. The mouthpiece 168 can be a bite-actuated mouthpiece that can be manipulated from a closed or sealed position to an open or dispensing position when a user applies pressure to the mouthpiece 168. A suitable mouthpiece 168 can be similar to the mouthpiece discussed and described in U.S. Pat. No. 6,497,348, which is incorporated by reference herein. In one or more embodiments, the valve 167 and the bite valve 168 can be used in combination, as shown, or only one may be used or none may be used. In at least one embodiment, the tube 121 can be free of any valves. A valve free tube 121 can include, for example, a cap, plug, or stopper, disposed on or about an end of the external portion 124 of the tube 121.

The second or internal portion 127 of the tube 121 disposed within the internal volume 106 can extend toward the bottom side 118 of the fluid reservoir 103. The distal end of the second portion 127 can be adjacent or proximate the bottom side 118 of the fluid reservoir 103. As illustrated, the bottom side 118 of the fluid reservoir 103 can be sloped to provide a lower region 171 along the bottom side 118 intermediate a third or "left" side 147 and a fourth or "right" side 150. This lower region 171 can facilitate the recovery of fluid disposed within the internal volume 106 via the tube 121, as fluid will flow, usually by force of gravity, toward the lower region 171. The distal end of the internal portion 127 of the tube 121 can include one or more notches, holes, or other modifications 130 that can maintain the flow of fluid from the internal volume and into the tube in the event that the distal end of the internal portion 127 engages a wall of the internal volume 106.

In one or more embodiments, an inner surface of the tube 121, for example the external portion 124 and/or the internal portion 127 can be coated or lined with one or more hydrophobic materials. The coating of one or more hydrophobic materials can promote the flow of a fluid within the tube 121 to flow therethrough with minimal "sticking" of the fluid on the inner surface of the tube 121. For example, if a fluid disposed within the internal volume 106 flows through the internal portion 127 and into the external portion 124 of the tube 121, the hydrophobic coating can promote the return of the fluid that does not exit the tube 121 to the internal volume 106. A flexible fluid reservoir 103 that is conformable can also urge fluid that may remain within the tube 121 after fluid removal to flow or return back, by suction or other force, to the internal volume 106.

In one or more embodiments, a greater portion of the length of the tube 121 can be disposed within the internal volume of the fluid reservoir 103 than is disposed exterior thereto. For example, the internal portion 127 can include about 55% or more, about 65% or more, about 75% or more, about 85% or more, about 90% or more, or about 95% or more of the tube 127. In other words, less than about 45%, less than about 35%, less than about 25%, less than about 15%, less than about 10%, or less than about 5% of the tube 121 can be disposed exterior to the internal volume 106.

The baffles 133 can be disposed between the top side 115 and the bottom side 118 in any suitable orientation. In at least one embodiment, the baffles 133 can be positioned substantially parallel to one another and the length of the baffles 133 can extend at least a portion of the distance between the top side 115 and the bottom side 118. In at least one other embodiment, the baffles 133 can extend between the left side 147 and the right side 150. In another embodiment, the baffles 133 can be arranged in a non-aligned configuration within the internal volume 106. In at least one other embodiment, the baffles 133 can be arranged diagonally between the left side 147 and the right side 150 and/or the top side 115 and the bottom side 118.

Figure 2:
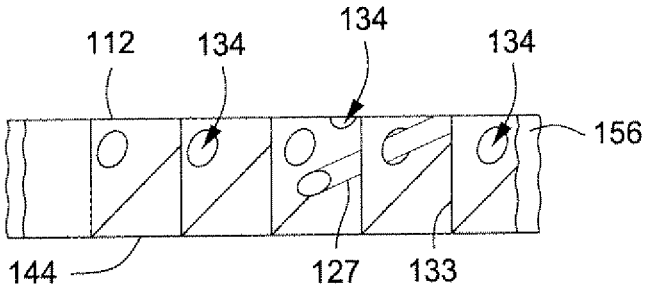
FIG. 2 depicts a cross-sectional view of the hydration system depicted in FIG. 1 along line 2-2.

The baffles 133 can be connected to the front wall 112 and the rear wall 144 within the internal volume 106. FIG. 2 depicts a cross-sectional view of the hydration system 100 depicted in FIG. 1 along line 2-2. Referring, to both FIGS. 1 and 2, the baffles 133 can be attached or otherwise connected to the front wall 112 and the rear wall 144 within the internal volume 106 using any suitable fastening device, system, or method. For example, the baffles 133 can be welded to the front wall 112 and the rear wall 144. In another embodiment, the baffles 133 can be stitched, riveted, or glued to the front wall 112 and the rear wall 144. The baffles 133 can be made from the same or different materials as the front wall 112 and the rear wall 144. The baffles 133 can be made from the same material or different materials with respect to one another. In at least one specific embodiment, a fluid reservoir 103 that is flexible can have baffles 133 that are flexible. For example, the baffles 133 can be made of the same or similar flexible and/or translucent material(s) as the front wall 112 and the rear wall 144. In at least one other specific embodiment, a fluid reservoir 103 having a rigid front and rear wall 112, 144 can include flexible baffles 133 and flexible sides disposed about the perimeter of the front and rear walls 112, 144. As such, when the internal volume 106 is free of liquid, the fluid reservoir 103 can be collapsed for storage. A flexible fluid reservoir 103 having flexible baffles 133 can also provide a more user friendly hydration system 100 that conforms to and moves with a user. A flexible reservoir 103 having flexible baffles 133 can provide a conformable or "compliant" hydration system 100 that can adapt or change the volume of the internal volume 106 as fluid is added or removed therefrom.

The internal portion 127 of the tube 121 can traverse one or more baffles 133 by passing through one or more openings 134 disposed through the baffles 133. As shown in FIG. 1, part of the internal portion 127 of the tube 121 can be substantially parallel to the longitudinal positioning of the baffles 133 and part of the internal portion 127 can traverse through an opening 134 (see FIG. 2) disposed through a baffle 133. In addition to the opening 134 through which the second portion 127 can pass, multiple holes or openings 134 can be disposed in one or more of the baffles 133. A plurality of holes or openings 134 disposed through the baffles 133 can facilitate the flow and distribution of a fluid disposed within the internal volume 106.

The baffles 133 can provide a structurally sound and/or structurally uniform fluid reservoir 103. For example, when a fluid is introduced to the internal volume 106, the baffles 133 can prevent or reduce the tendency for a flexible fluid reservoir 103 to "balloon" outwardly in a disproportionate fashion, i.e. to outwardly expand at the bottom side 118, with the top side 115 being comparatively flattened. Thus, the baffles 133 can form the fluid reservoir 103 into a relatively uniform cross-sectional shape or constant thickness from the top side 115 to the bottom side 118 when a liquid is disposed within the internal volume 106. Similarly, the baffles 133 can provide a fluid reservoir 103 with a relatively uniform or constant thickness from the left side 147 to the right side 150. In one or more embodiments, the average thickness of the fluid reservoir 103 having a liquid disposed within the internal volume 106 can range from a low of about 0.5 cm, about 1 cm, or about 1.5 cm to a high of about 5 cm, about 10 cm, or about 15 cm. For example, when a liquid is disposed within the internal volume 106, the fluid reservoir 103 can have a thickness of about 2.5 cm, about 3 cm, about 4 cm, about 5 cm, about 6 cm, or about 7 cm. The fluid that is disposed within the internal volume 106 can be any desired fluid, for example a consumable liquid. Illustrative consumable liquids can include water, juices, sports drinks, or the like.

Figure 3:
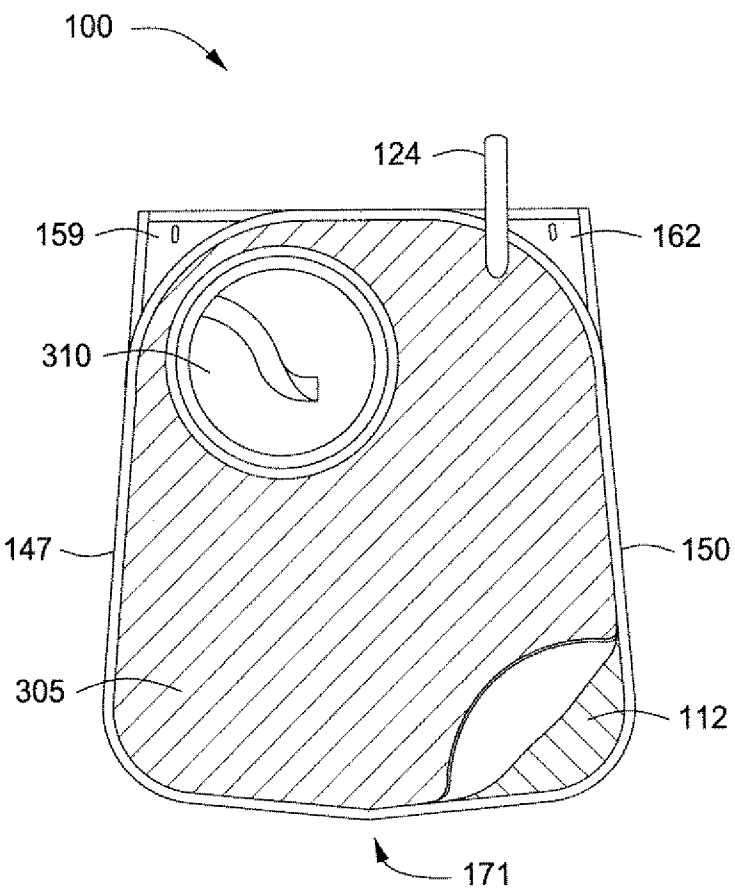
FIG. 3 depicts an elevational front view of an illustrative hydration system that includes an insulation layer disposed about the front wall, according to one or more embodiments described.

FIG. 3 depicts an elevational front view of an illustrative hydration system 100 that includes an insulation layer 305 disposed about the front wall 112, according to one or more embodiments. The insulation layer 305 can be any suitable material that exhibits insulating properties. Illustrative insulation materials can include, but are not limited to, aerogel, cotton, fiberglass, wool, polymeric fibers, natural fibers, polymer foams, cellulose, or the like. The insulation layer 305 can be in any type or form. For example, the insulation material that provides at least a portion or part of the insulation layer 305 can be in the form of beads, fibers, threads, foams, gels, sheets, foils, films, or the like. In at least one specific embodiment, the insulation layer can be a sheet of material or fabric that can include one or more insulating components, such as aerogel.

In one or more embodiments, the insulation layer 305 can be separate and independent from the front wall 112 of the fluid reservoir 103. In one or more embodiments, the insulation layer 305 can be attached or otherwise connected to the front wall 112 using any suitable fastening system, device, or method. For example, the insulation layer 305 can be connected to the front wall 112 using an adhesive, stitching, rivets, welding, clamps or other pressure applying devices, pins, buttons, or any combination thereof. In one or more embodiments, the insulation layer 305 can be part of a pack or apparatus that can be used to support the hydration system 100. In one or more embodiments, the insulation layer 305 can be integrated into or within the front wall 112. For example, the front wall 112 can include two or more layers of material and the insulation layer 305 can be disposed between any two or more of those layers to provide one or more insulation layers within the front wall 112. In one or more embodiments, the insulation layer 305 can be disposed about or on the front wall 112 within the internal volume.

The insulation layer 305 can reduce heat flow or heat loss from the interior volume 106 through the front wall 112 to the exterior environment that is adjacent or proximate the front wall 112. The insulation layer 305 can have an R-value of at least about 0.25 $K \cdot m^2/W$, at least about 0.35 $K \cdot m^2/W$, at least about 0.5 $K \cdot m^2/W$, at least about 0.7 $K \cdot m^2/W$, at least about 0.9 $K \cdot m^2/W$, at least about 1 $K \cdot m^2/W$, about 1.2 $K \cdot m^2/W$, at least about 1.4 $K \cdot m^2/W$, at least about 1.6 $K \cdot m^2/W$, or at least about 1.7 $K \cdot m^2/W$, or at least about 1.8 $K \cdot m^2/W$ per 2.5 cm of thickness. For example, the R-value can range from a low of about 0.25 $K \cdot m^2/W$, about 0.55 $K \cdot m^2/W$, or about 0.65 $K \cdot m^2/W$ to a high of about 1.5 $K \cdot m^2/W$, about 1.65 $K \cdot m^2/W$, or about 1.8 $K \cdot m^2/W$ per 2.5 cm of thickness.

The fill port 153 (see FIG. 1) can include a removable cap, lid, plug, or the like 310 that can provide a liquid tight seal about a perimeter of the fill port 153. The fill port 153 can provide access to the interior volume 106 for the introduction of a fluid thereto. A suitable fill port 153 can be similar to the fill port discussed and described in U.S. Pat. Nos. 6,497,348 and 7,063,243, which are incorporated by reference herein. A suitable cap 310 can be similar to the cap discussed and described in U.S. Pat. Nos. 6,497,348 and 6,820,780, which is incorporated by reference herein. In another embodiment, rather than having a removable cap 310, the fluid reservoir 103 can include an integral or permanent fluid introduction device (not shown), such as an inlet nozzle or valve adapted to selectively provide fluid communication between the internal volume 106 and the exterior.

Similar to the front wall 112, the cap 310 can be or include one or more insulative materials. For example, an insulation layer 305 that can be attached to or otherwise disposed about the front wall 112 can also be attached to or disposed about the cap 310. The cap 310 can include one or more insulative materials disposed therein. A pack or apparatus (not shown) that can be used to support and/or carry the hydration system 100 can provide an insulative layer about the cap 310.

Figure 4:
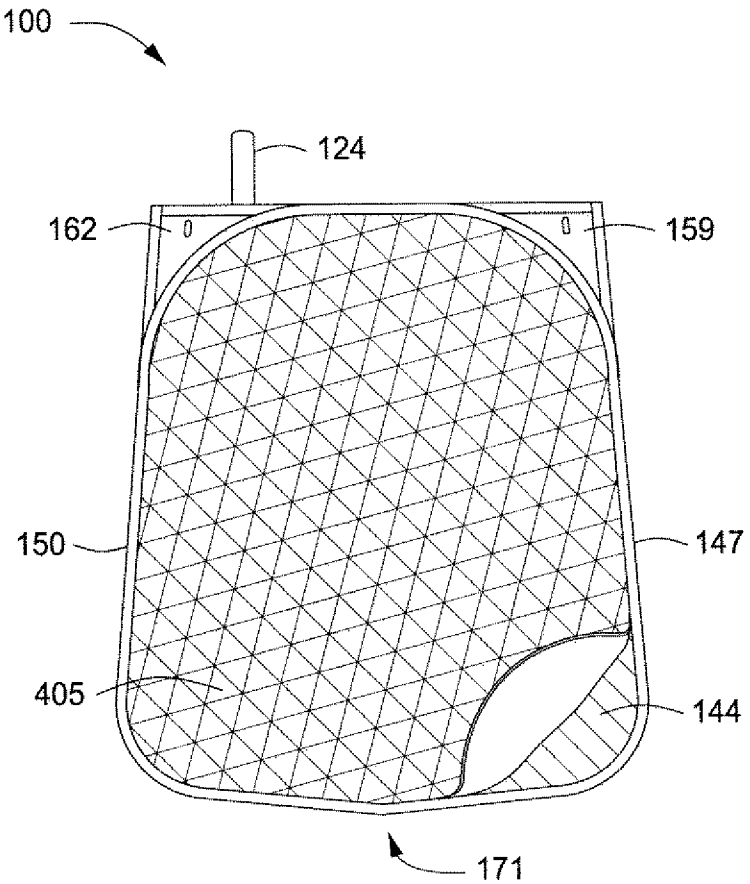
FIG. 4 depicts an elevational rear view of the hydration system depicted in FIG. 3, having a heat transfer layer disposed about the rear wall, according to one or more embodiments described.

FIG. 4 depicts an elevational rear view of the hydration system 100 depicted in FIG. 3, having a heat transfer layer 405 disposed about the rear wall 144, according to one or more embodiments. The heat transfer layer 405 can be any suitable material that exhibits heat transferring properties. Illustrative heat transfer materials can include, but are not limited to metals, heat conductive polymers, or the like. The heat transfer layer 405 can be in any configuration or form. For example, the heat transfer material that provides at least a portion or part of the heat transfer layer 405 can be in the form of beads, fibers, threads, foams, gels, mesh, wires, sheets, foils, films, or the like. In at least one specific embodiment, the heat transfer layer 405 can be a sheet or mesh screen that can include one or more metallic materials, e.g. copper or aluminum. In another example, the heat transfer layer 405 can be a tubular mesh screen that can be disposed about the external portion 124, for example.

The heat transfer layer 405 can be separate and independent from the rear wall 144 of the fluid reservoir 103. The heat transfer layer 405 can be attached or otherwise connected to the rear wall 144 using any suitable fastening system, device, or method. For example, the insulation layer 305 can be connected to the rear wall 144 using an adhesive, stitching, rivets, welding, clamps or other pressure applying devices, pins, buttons, or any combination thereof. The heat transfer layer 405 can be part of a pack or apparatus that can be used to support the hydration system 100. The heat transfer layer 405 can be integrated into or within the rear wall 144. For example, the rear wall 144 can include two or more layers of material and the heat transfer layer 405 can be disposed between any two or more of those layers to provide one or more heat transfer layers within the rear wall 144. The heat transfer layer 405 can be disposed on the rear wall 144 within the internal volume.

Heat can be transferred from an exterior source of heat, e.g. a person wearing the hydration system 100 about his/her body, to the internal volume 106. In at least one embodiment, the heat transfer layer 405 can store at least a portion of the heat transferred from an exterior heat source, e.g. a person. Similarly, if a fluid disposed within the internal volume 106 has a temperature that is greater than the exterior temperature adjacent the heat transfer layer 405, heat can be transferred from the internal volume to the heat transfer layer 405.

Figure 5:
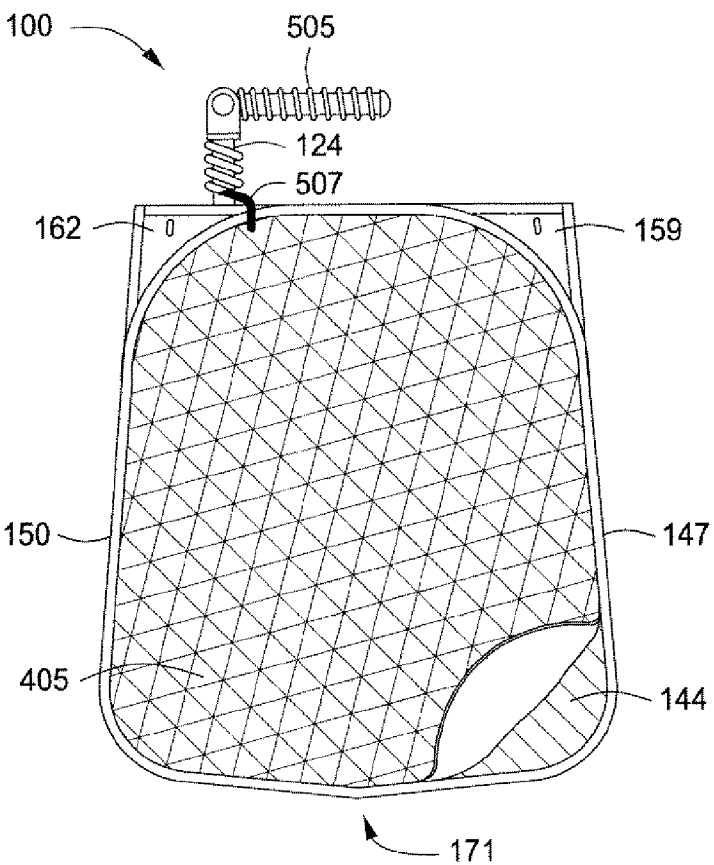
FIG. 5 depicts an elevational rear view of the hydration system depicted in FIG. 4 and further having a heat receiving member disposed about a tube that is in fluid communication with an internal volume of the hydration system, according to one or more embodiments described.

Referring now to FIG. 5, an elevational rear view of the hydration system 100 of FIG. 4 is shown further comprising a heat receiving member 505 disposed about the external portion 124 of tube 121. In one or more embodiments configured as shown in FIG. 5, the hydration system 100 comprises a combination configured such that heat can be "passively" transferred, i.e. no "active" heating component, such as a heater powered by a battery or other power source, is employed. Instead, heat can be transferred from the heat transfer layer 405 to the heat receiving member 505 via one or more heat transfer members 507. The heat receiving member 505 can be or include one or more materials suitable for receiving heat via the heat transfer member 507. For example, the heat receiving member 505 can include, but is not limited to, a metallic mesh, a graphite mesh, a coiled wire, thermally conductive pastes or gels, heat conductive polymers, or the like. The heat receiving member 505 can be disposed about, within, and/or inside the external portion 124 of tube 121. The one or more heat transfer members 507 can include any material suitable for transferring heat or energy from the heat transfer layer 405 to the heat receiving member 505. For example, the heat transfer member 507 can include, but is not limited to, a metallic mesh, a graphite mesh, heat conductive polymers, thermally conductive pastes or gels, a coiled wire, or the like.

Figure 6:
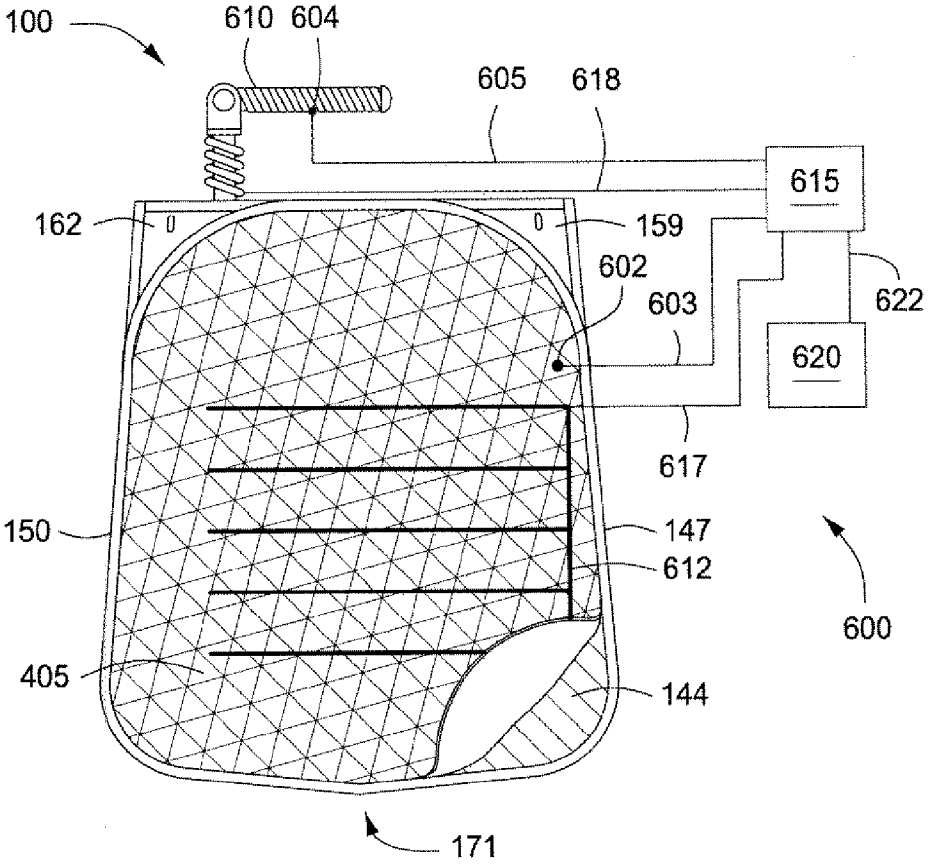
FIG. 6 depicts an elevational rear view of the hydration system depicted in FIG. 4 and further having an active heating system disposed about the hydration system, according to one or more embodiments described.

FIG. 6 depicts an elevational rear view of the hydration system 100 of FIG. 4 further comprising an "active" heating system 600 disposed about the hydration system 100, according to one or more embodiments. The heating system 600 is described as "active" because the system uses energy from another power source, such as a battery or solar cell, separate from the mere "passive" conductance of heat, such as, by non-limiting example, body heat from the torso of the user of the hydration system. The "active" heating system 600 comprises one or more temperature sensors (two are shown as parts 602, 604), means for actively heating at least a portion of the hydration system 100, e.g. active heat transfer members 610, 612, temperature monitor/controllers ("temperature controller") 615, and a power supply 620. The temperature sensors 602, 604 can be disposed about the hydration system 100 at any number of locations. As shown, the temperature sensor 602 is disposed on the heat transfer layer 405 and the temperature sensor 604 is disposed on the external portion 124 of the tube 121. Other suitable locations for one or more temperature sensors can include, but are not limited to, within the internal volume 106, within an inner diameter of tube 121, about the front wall 112, about the cap 310, or any combination thereof. The active heat transfer members 610, 612 can be disposed about any location of the fluid reservoir 103 and/or the tube 121. As shown, the active heat transfer member 610 is disposed about the external portion 124 of the tube 121, and the active heat transfer member 612 is disposed about the heat transfer layer 405. Other suitable locations for one or more active heat transfer members 610, 612 can include, but are not limited to, between the heat transfer layer 405 and the rear wall 144, within the rear wall 144, within the internal volume 106, within the tube 121, about the front wall 112, or any combination thereof.

The temperature sensors 602, 604 can provide data that can be used by the temperature controller 615 to determine or estimate a temperature. Data from the temperature sensors 602. 604 can be input via lines 603, 605, respectively, to the temperature controller 615. Although a physical link or connection between the temperature sensors 602, 604 and the temperature controller 615 is shown, wireless communication can also be employed. The temperature controller 615 can perform one or more operations or calculations based on the data provided by the temperature sensors 602, 604 in order to determine whether active heating should be initiated or stopped. For example, temperature sensor 602 can provide data via line 603 indicative of a temperature within or about the heat transfer layer 405 to the temperature controller 615. The temperature controller 615 can determine if a predetermined upper or lower temperature limit has been met or exceeded. If a lower temperature limit has been met or exceeded, the temperature controller 615 can receive power, such as an electric current, via line 622 from power supply 620 and direct the power via line 617 to the active heat transfer member 612. For a resistance-based heater, the passing of an electric current through a resistance such as a wire or other obstacle that impedes the flow of current and causes the heater to emit heat. Thus, the power to the active heat transfer member 612 is converted into thermal energy. At least a portion of the thermal energy generated within the active heat transfer member 612 can be transferred to the internal volume 106. Similarly, if an upper temperature limit has been met or exceeded, the temperature monitor 615, if actively transferring power to the active heat transfer member 612, can stop the transfer of electrical current (power) thereto.

In another example, the temperature sensor 604 can provide data via line 605 indicative of a temperature within or about the external portion 124 to the temperature controller 615. The temperature controller 615 can determine if a predetermined upper or lower temperature limit has been met or exceeded. If a lower temperature limit has been met or exceeded, the temperature controller 615 can receive power from the power supply 620 via line 622 and direct the power via line 618 to the active heating member 610. The power directed from the temperature controller 615 can be converted into thermal energy in the active heating member 610. At least a portion of the thermal energy generated within the active heating member 610 can be transferred to the external portion 124 and/or to an internal volume of the external portion 124. Similarly, if an upper temperature limit has been met or exceeded, the temperature monitor 615, if actively transferring power to the active heating member 610, can stop the transfer of power thereto.

The temperature controller 615 can independently transfer or direct power via lines 617, 618 to the active heating members 612, 610 respectively. However, the temperature controller 615 can be configured to simultaneously transfer power via lines 617, 618 to the active heating members 612, 610, respectively, should either temperature sensor 602 or 604 indicate that a lower temperature limit has been met or exceeded.

The temperature controller 615 can be configured to control transfer of sufficient power to the active heat transfer member 612 such that the temperature of the rear wall 144 and/or a fluid disposed within the internal volume 106 can reach or rise above a second desired temperature, such as an upper temperature limit or a temperature intermediate a lower temperature limit and the upper temperature limit. Similarly, the temperature controller 615 can transfer power to the active heating member 610 to cause the temperature of the external portion 124 and/or a fluid disposed within the external portion 124 to reach or rise above a desired temperature, for example an upper temperature limit or a temperature intermediate a lower temperature limit and the upper temperature limit. In one embodiment, the lower temperature limit can be greater than 0° C. In another embodiment, the lower temperature limit can be about 1° C. or more, about 1.5° C. or more, or about 2° C. or more, or about 2.5° C. The upper temperature limit can be about 25° C. or less, about 20° C. or less, about 15° C. or less, about 10° C. or less, about 5° C. or less, or about 4° C. or less. For example, the combination of the lower temperature limit and upper temperature limit can be a range from about 0.5° C. to about 5° C., or from about 1° C. to about 7° C., or from about 1.75° C. to about 4° C.

The temperature controller 615 can be or include one or more pre-programmed processors that operate in a predetermined manner based on the interpretation of data received from the one or more temperature sensors 602, 604. The temperature controller 615 can include an interface that permits a user to alter/re-program the temperature controller setpoint 615. For example, the temperature controller 615 can include an interface that allows a user to adjust the upper and/or lower settings of temperature that the temperature controller 615 uses to determine whether or not electrical power should be supplied to the means for active heating members 610 and 612. The temperature controller 615 may comprise its own separate power supply or can draw power necessary for its operation from the power supply 620.

The temperature sensors 602, 604 can comprise any suitable device or means for sensing temperature. For example, the temperature sensors 602, 604 can include resistance temperature devices (RTDs), thermistors, thermocouples, diodes, thermopiles or a metal foil or metal wire heater with a high temperature coefficient of resistance together with a suitable controller.

In another embodiment, either one or both of the heat transfer members 610, 612 can comprise means for active heating that also serves the function of sensing or measuring temperature without discrete temperature sensors 602, 604. Such an embodiment comprises a foil or wire heater strip made from copper, nickel, nickel-iron, or other material having a relatively high temperature coefficient of resistance (TCR). A compatible DC controller means 615 would sense changes in the temperature dependent resistance of the heater strip itself and be calibrated to apply power when the external resistance meets or exceeds a threshold value that corresponds to a particular set-point temperature of interest, such as for instance 2° C. In other words, the means for heating 610, 612 use their own thermal properties of resistivity to sense the temperature and control the application of active heating. An example of such an integrated combination of means for temperature sensing, heating and temperature control can comprise the Heaterstat™ Sensorless DC Controllers sold by Minco Products, Inc.

The power supply 620 comprises one or more batteries or capacitors. The means for supplying power could be substituted with solar cells, or the power supply 620 could be supplemented with solar cells to extend the life of the system during periods of exposure to the sun.

The active heating members 610, 612 can be any heating device capable of generating heat when power is supplied thereto. The active heating members 610, 612 can be a thin flexible resistance heater, such as a heater tape assembly. A suitable heating member 610, 612 can be or include Thermofoil™ flexible heaters manufactured by Minco. The Thermofoil™ flexible heaters include an etched-foil resistive element laminated between layers of flexible insulation. The insulation includes an insulative polyimide-based material such as Kapton® constructed in thin sheets to form a casing that surrounds the etched-foil resistive element.

As shown, the active heating member 612 can be disposed on the heat transfer member 405. However, the active heating member 612 can replace the heat transfer layer 405, be disposed intermediate the rear wall 144 and the heat transfer layer 405, within the internal volume 106, or a combination thereof.

Although not shown, a plurality of active heating systems, e.g. multiple temperature monitors/controllers 615 that monitor one or more temperature sensors and actively provide power or stop power to one or more heat transfer members can be disposed about the hydration system 100 and can be independently controlled or operated.

Figure 7:
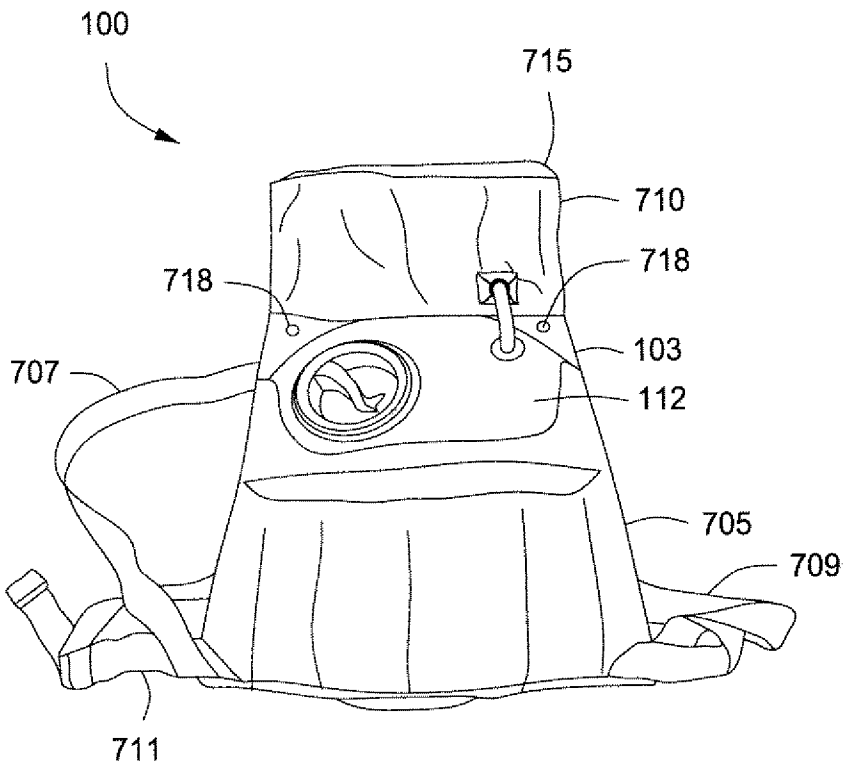
FIG. 7 depicts a front view of another embodiment of a hydration system comprising a fluid reservoir and an illustrative pack, according to one or more embodiments described.

FIG. 7 depicts a front view of the hydration system 100 depicted in FIG. 1 further comprising an illustrative pack 705, according to one or more embodiments. The pack 705 can be flexible or rigid and can support the fluid reservoir 103. In one or more embodiments, the pack 705 can provide complete coverage or at least coverage about a majority (i.e. greater than 50%) of the surface area of the front wall 112. The pack 705 can include an opening to a pouch, slot, or other cavity that contains or houses the fluid reservoir 103. As depicted, the pack 705 can include a flap 715 that can be folded down over the opening through which the fluid reservoir 103 or hydration system 100 can be inserted. The flap 715 can be secured to the front wall 112 and/or the pack 705 using any suitable fastening system or device. For example, the flap 715 can be secured to front wall 112 and/or the pack 705 with a hook and loop fastener, one or more buttons, pins, zippers, clips, or combinations thereof. In at least one embodiment, the fluid reservoir 103 of hydration system 100 can be secured to the pack 705 with two buttons 718, which can be connected to the pack 705 and disposed through the openings 165 (see FIG. 1) in the tab portions 159, 162.

The pack 705 can include one or more straps, handles, or other extensions (three are shown 707, 709, 711). A first strap 707 can be disposed about a first side of the pack 705, a second strap can be disposed about a second side of the pack 705, and a third strap can be disposed between the first and second sides of the pack 705. The straps 707, 709, 711 can be used to secure the pack 705 about a user. For example, the straps 707, 709 disposed on the first and second sides of the pack 705 can be placed around the shoulders of a user and the strap 711 can be placed around his/her waist or back. As such, the pack 705 can be disposed about the chest of a user or the back of the user providing "hands free" carrying of the hydration system 100. The pack 705 can be configured to dispose the hydration system 100 in front of a user, such that the rear wall 144 faces or is proximal the user's chest and the front wall 112 is distal the user's chest. In another embodiment, the pack 705 can be configured to dispose the hydration system 100 about the hack of a user, such that the rear wall 144 faces or is proximal the user's back and the front wall 112 is distal the user's back.

The pack 705 can be made of any material suitable for supporting the hydration system 100, for example natural and/or synthetic fabrics. In one or more embodiments, the pack 705 can be made of or include one or more insulative materials. Illustrative insulating materials can be or include materials similar to the insulation layer 305 discussed and described above with reference to FIG. 3. As such, the pack 705 can provide insulation about the front wall 112, which can reduce or eliminate the need for the insulation layer 305. In one or more embodiments, a pack 705 that includes one or more insulating materials can provide additional insulation to an insulation layer 305 disposed about the front wall 112 of the fluid reservoir 103. In one or more embodiments, the pack 705 can be made from a polymeric material or fabric, for example polytetrafluoroethylene.

In one or more embodiments, the pack 705 can be integrated with an article of clothing. For example, the pack 705 can be or include a pouch formed into a shirt, jacket, or the like. The side of the pouch integrated with the article of clothing that is oriented toward a person wearing the article of clothing can be thin and/or have a majority of the surface open. In other words, the side of the pouch oriented toward the person can facilitate heat transfer between the internal volume 106 of the fluid reservoir 103 (see FIG. 1) and the person. Conversely, the side of a pouch integrated with the article of clothing that is oriented away from a person wearing the article of clothing can be insulated to reduce heat transfer between such side and the internal volume 106 so as to keep a fluid inside from freezing during exposure of the hydration system 100 to extremely cold temperatures.

Figure 8:
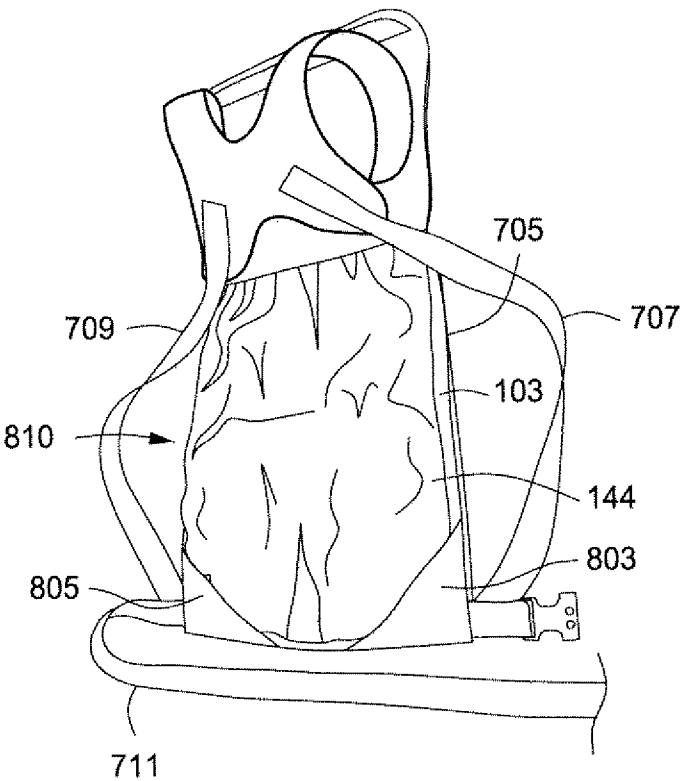
FIG. 8 depicts a rear view of the illustrative pack of FIG. 7.

FIG. 8 depicts a rear view of the hydration system 100 of FIG. 7 with the fluid reservoir 103 disposed within the pack 705. As shown, the rear or back side 810 of the pack 705 can be open to expose the rear wall 144 of the fluid reservoir 103. For example, about 30% or more, about 40% or more, about 50% or more, about 60% or more, about 70% or more, about 80% or more, about 90% or more, or about 95% or more of the rear wall 144 can be exposed or otherwise not covered by the pack 705. In at least one specific embodiment, the rear side 810 of the pack 705 can be a substantially open structure, such as netting or mesh.

In one or more embodiments, corner tabs or corner pockets 803, 805 can be located at the bottom of the pack 705 about the rear side 810. The corner tabs 803, 805 can secure the fluid reservoir 103 within the pack 705, thus preventing the fluid reservoir 103 from becoming dislodged from the pack 705.

Figure 9:
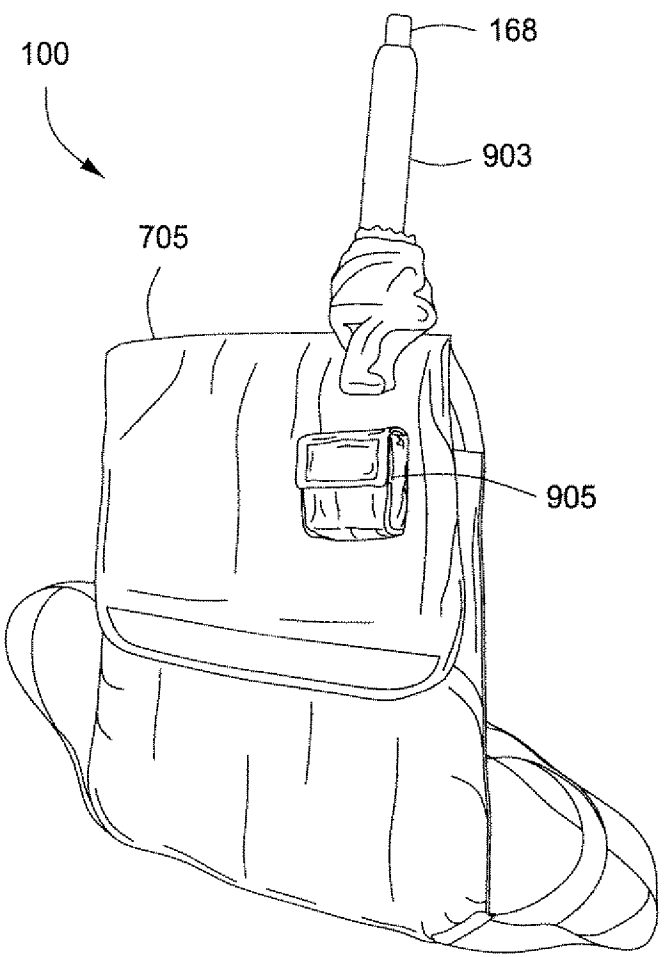
FIG. 9 depicts an isometric view of an illustrative hydration system disposed within a closed pack, according to one or more embodiments described.

FIG. 9 depicts an isometric view of an illustrative hydration system 100 further comprising a closed pack 705, according to one or more embodiments. As discussed above with reference to FIGS. 7 and 8, when the pack 705 is closed the hydration system 100 of FIG. 1 can be contained within the pack 705. In one or more embodiments, an insulating material or insulation layer 903 can be disposed about the external portion 124 of the tube 121. The insulation layer 903 can include, but is not limited to, one or more layers of insulating material. Suitable insulating materials can be or include similar materials as the insulation layer 305, discussed and described above with reference to FIG. 3. For example, the insulation 903 can include an inner layer of polytetrafluoroethylene, an intermediate layer of aerogel or aerogel embedded fabric, and an outer layer of polytetrafluoroethylene. The valve 167 (see FIG. 1) can allow the external portion 124 of the tube 121 to be folded outward and away from the pack 705. As such, a user wearing the pack 705 containing the hydration system 100 about his chest can easily withdraw a fluid contained within the internal volume 106 of the fluid reservoir 103 via the tube 121.

In one or more embodiments, a user (not shown) wearing the pack 705 having the hydration system 100 disposed therein can maintain a liquid, e.g. water, disposed within the internal volume 106 in the liquid state while in a cold environment with or without the active heating system. For example, heat from the user can flow through the rear wall 144 of the fluid reservoir 103 to a liquid disposed within the internal volume 106. A liquid, such as water, having a freezing point of 0° C. can be maintained at or above 0° C. while the user is in a cold environment for an extended period of time. The environment can be at a temperature of about −60° C., about −50° C., about −40° C., about −35° C., about −30° C., about −25° C., about −20° C., about −15° C., about −10°

C., about −5° C., or about −1° C. and the temperature of water within the internal volume can be at or above 0° C. The period of time that a liquid disposed within the internal volume 103 can be maintained at or above 0° C. (for example) can be about 3 hours, about 7 hours, about 9 hours, about 13 hours, about 17 hours, about 21 hours, about 25 hours, or about 29 hours.

If the hydration system includes an active heating system, such as the active heating system 600 discussed and described above with reference to FIG. 6, the controller 615 can be disposed within a pouch or pocket 905 located on the exterior of the pack 705. Disposing the controller 615 within the outer pocket 905 can allow a user to access the controller 615 without having to open the pack 705.

Figure 10:
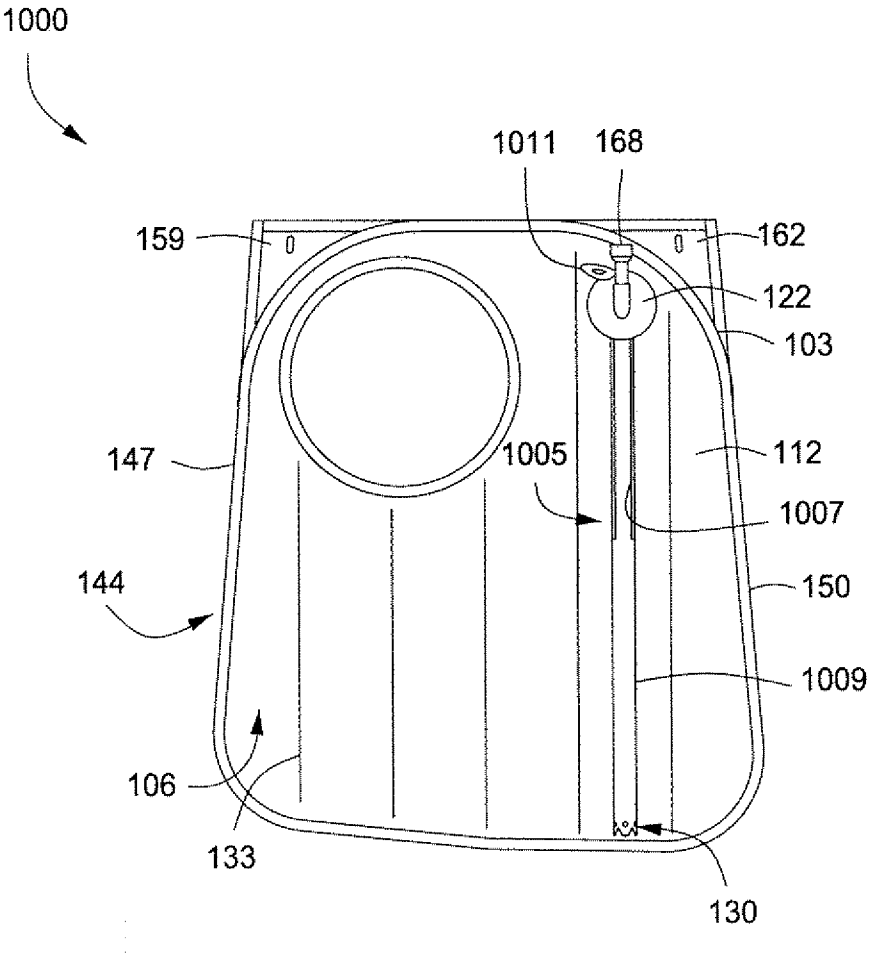
FIG. 10 depicts a schematic of another illustrative hydration system comprising a telescoping tube, according to one or more embodiments.

FIG. 10 depicts a schematic of another illustrative hydration system 1000 having a telescoping tube 1005, according to one or more embodiments. The hydration system 1000 can comprise similar components in combination as discussed and described above with reference to the hydration system 100 of FIGS. 1-9, but such system 1000 substitutes the tube 121 with the telescoping tube 1005. The telescoping tube 1005 can comprise two or more sections of tube (two are shown in this embodiment as parts 1007, 1009). In one or more embodiments, the first section 1007 can longitudinally move in and out of a second section 1009. In one or more embodiments, the first section 1007 can longitudinally move about the second section 1009. A telescoping tube 1005 allows the first section 1007 to temporarily extend outside the internal volume 106. Therefore, exposure of the first section 1007 to the exterior environment can be minimized. Minimizing the exposure of the first section 1007 to the exterior environment, especially an extremely cold environment, can reduce the probability that a temperature of an interior surface of the first section 1007 and any fluid therein will approach the temperature of the exterior environment. The telescoping tube 1005 can reduce or eliminate the need for disposing one or more insulative materials about the tube 1005. In one or more embodiments, the first section 1007 can further comprise a loop, tab, or handle 1011 to facilitate the movement of this section as it extends out of the internal volume 106. In another embodiment, the first section 1007 can further comprise a compression-spring loaded device or other means for forcing the extensible portion 1007 back into a retracted position within the non-extensible portion of tube 1009, the interior volume 106 of the reservoir, or both.

In one or more embodiments, an interior surface of the first section 1007 and/or the second section 1009 can be made of or include a liquid repelling material. For example, an interior surface of the first section 1007 and/or the second section 1009 can be coated with one or more hydrophobic materials, which can promote the return of a fluid within the tube 1005 to flow through the tube 1005 rather than to "stick" or "cling" to an interior surface thereof.

In one or more embodiments, the first section 1007 and the second section 1009 can include one or more stop mechanisms that can prevent the first section 1007 from being completely removed from within or about the second section 1009. For example, an end of the first section 1007 disposed within the second section 1009 can include a tab, ring, ridge, or other protrusion disposed thereon that can engage or contact a stop disposed on, in, or about the second section 1009 when the first section 1007 is extended from the second section 1009. The stop can prevent the first section 1007 from being completely removed from within or about the second section 1009.

Both tube 121 and telescoping tube 1005 can comprise a valve 168 for enabling access to the fluid contained within reservoir 103. In one or more other embodiments, valve 168 instead comprises a connector 168 for interfacing with an oxygen mask. The oxygen mask is a component of a system for supplying oxygen, which is used in environments having low levels of breathable air, such as, on Earth, places of high altitude (e.g., mountains), or in space, extra-terrestrial bodies such as the moon or an asteroid.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference for all jurisdictions in which such incorporation is permitted.

While the foregoing description is directed to embodiments of the present invention, other and further embodiments of the invention may be devised without departing from the basic scope thereof, and the scope thereof is determined by the claims that follow.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function and step-plus-function clauses are intended to cover the structures or acts described herein as performing the recited function and not only structural equivalents, but also equivalent structures. Thus, while a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An apparatus for storing and delivering fluid to a person, comprising:

a fluid reservoir having an internal volume therein;

an opening disposed through a first wall or a second wall of the fluid reservoir and located toward a first end of the fluid reservoir;

a tube, wherein a first portion of the tube is exterior to the fluid reservoir and a second portion of the tube is disposed through the opening and within the internal volume;

at least one insulation layer disposed about the exterior of the first wall of the fluid reservoir, wherein the second wall of the fluid reservoir is configured to transfer heat to or from the internal volume;

at least one baffle disposed within the internal volume and connected to the first wall and the second wall of the fluid reservoir; and at least one of a first heat transfer member disposed about the second wall of the fluid reservoir and a second heat transfer member disposed about the first portion of tube.

2. The apparatus of claim 1, wherein the first portion of the tube telescopes within or about the second portion of the tube.

3. The apparatus of claim 1, further comprising insulation disposed about at least a portion of the first portion of the tube.

4. The apparatus of claim 1, wherein the fluid reservoir is made of a flexible material and wherein the second portion of the tube is greater in length than the first portion of the tube.

5. The apparatus of claim 1, further comprising a valve disposed on the tube.

6. The apparatus of claim 1, wherein the first heat transfer member conducts heat to at least one of the internal volume and the second heat transfer member.

7. The apparatus of claim 1, further comprising a sealable port disposed through the first wall of the fluid reservoir and toward the first end of the fluid reservoir, wherein the sealable port comprises an insulative material.

8. The apparatus of claim 1, further comprising an active heating system disposed about the apparatus and configured to heat the internal volume, the first portion of the tube, or both.

9. The apparatus of claim 1, wherein each baffle comprises at least one hole disposed therethrough, wherein the second portion of the tube passes through the at least one hole, and wherein an end of the second portion of the tube is located proximate a second end of the fluid reservoir.

10. The apparatus of claim 1, further comprising a pack, wherein the fluid reservoir is supported by the pack, and wherein the insulation disposed about the exterior of the first wall of the fluid reservoir is integral to the pack, fixedly disposed to the exterior of the first wall of the fluid reservoir, disposed within the first wall of the fluid reservoir, or any combination thereof.

11. The apparatus of claim 9, wherein the at least one baffle is operatively positioned to be connected to the first wall and the second wail so as to form the fluid reservoir to have a relatively uniform cross-sectional thickness from the first end to the second end when fluid is contained therein.

12. An apparatus for storing and delivering fluid to a person, comprising:

a flexible fluid reservoir having an internal volume therein;

an opening disposed through a first wall or a second wall of the fluid reservoir and located toward a first end of the fluid reservoir;

a tube, wherein a first portion of the tube is exterior to the fluid reservoir and a second portion of the tube is disposed through the opening and within the internal volume;

at least one insulation layer disposed about the exterior of the first wall of the fluid reservoir, wherein the second wall of the fluid reservoir is configured to transfer heat to or from the internal volume; and at least one pair of baffles disposed within the internal volume and operatively connected to the first wall and the second wall, wherein the second portion of the tube is positioned such that part of the second portion of the tube extends in substantially the same longitudinal direction as the at least one pair of baffles and part of the second portion of the tube traverses through an opening disposed through one baffle of the at least one pair of baffles.

13. The apparatus of claim 12, wherein the first portion of the tube telescopes within or about the second portion of the tube.

14. The apparatus of claim 12, further comprising insulation disposed about at least a portion of the first portion of the tube, wherein the second portion of the tube is greater in length than the first portion of the tube.

15. The apparatus of claim 12, further comprising a first heat transfer member disposed about the second wall of the fluid reservoir and a second heat transfer member disposed about the first portion of the tube.

16. The apparatus of claim 12, farther comprising an active heating system disposed about the apparatus and configured to heat the internal volume, the first portion of the tube, or both.

17. The apparatus of claim 12, further comprising a pack, wherein the fluid reservoir is supported by the pack, and wherein the insulation disposed about the exterior of the first wall of the fluid reservoir is integral to the pack, fixedly disposed to the exterior of the first wall of the fluid reservoir, disposed within the first wail of the fluid reservoir, or any combination thereof.

18. The apparatus of claim 12, wherein the at least one pair of baffles are positioned so as to form the fluid reservoir to have a relatively uniform cross-sectional thickness from the first end to a second end of the fluid reservoir when fluid is contained therein.

19. A method for storing and delivering fluid to a person, comprising the steps of:

introducing a fluid to an internal volume of a hydration system, wherein the hydration system comprises:

a fluid reservoir having the internal volume therein;

an opening disposed through a first wall or a second wall of the fluid reservoir and located toward a first end of the fluid reservoir;

a tube, wherein a first portion of the tube is exterior to the fluid reservoir and a second portion of the tube is disposed through the opening and within the internal volume;

at least one insulation layer disposed about the exterior of the first wall of the fluid reservoir, wherein the second wall of the fluid reservoir is configured to transfer heat to or from the internal volume, collect heat from an external source, or both;

at least one baffle disposed within, the internal volume and connected to the first wall and the second wall of the fluid reservoir, wherein the second wall is proximal to the person and the first wall is distal to the person;

positioning the hydration system about the person, collecting heat from the person over a surface area of the second wall; and transferring at least a portion of the collected heat to the first portion of the tube.

20. The method of claim 19, wherein the first portion of the tube telescopes within or about the second portion of the tube.

21. The method of claim 19, further comprising the step of actively heating at least a portion of the fluid within the internal volume, the first portion of the tube, or both.

22. The method of claim 21, further comprising the step of sensing temperature locus to the first portion of the tube.

23. The method of claim 22, further comprising the step of controlling the step of actively heating based at least in part on the temperature being sensed.

24. The method of claim 19, further comprising removing at least a portion of the fluid through the tube.

25. A hydration system, comprising:

means for storing a fluid, said means for storing including a first flexible wall and a second flexible wail operatively connected to one another so as to provide an internal volume therein, said means for storing further comprising at least one pair of baffles, each baffle being disposed within the internal volume and connected to an interior surface of the first flexible wall and an interior surface of the second flexible wall, said means for storing including an opening disposed through the first flexible wall or the second flexible wall, said means for storing being configured in shape and size such that the second flexible wall transfers heat from a person using the hydration system to the internal volume;

means for conveying fluid stored within the internal volume, wherein a first portion of said means for conveying is exterior to said means for storing and a second portion of said means for conveying is disposed through the opening disposed through the first flexible wall or the second flexible wall and within the internal volume;

means for insulating said means for storing, said insulating means being disposed about an exterior surface of the first flexible wall; and means for supporting said means for storing in a position about an upper torso of the person using the hydration system, said means for supporting further comprising means for snuggling said means for storing in close proximity to or near the upper torso of the person using the hydration system.

26. The system of claim 25, wherein the means for conveying further comprises a valve for controlling a rate of flow of the fluid being conveyed.

27. The system of claim 25, further comprising means for actively heating fluid stored within the internal volume.

28. The system of claim 27, wherein the means for actively heating further comprises means for automatically controlling the means for actively heating.

29. The system of claim 25, further comprising means for introducing fluid to the means for storing.

30. The system of claim 25, wherein the means for conveying fluid further comprises means for telescoping the means for conveying into and out of the internal volume.

31. The system of claim 25, further comprising means for transferring body heat from the user through the second flexible wall and to the internal volume.

32. A hydration system, comprising:

a fluid reservoir for storing a liquid, the fluid reservoir comprising a first flexible and translucent wall and a second flexible wall operatively connected to one another so as to provide an internal volume therein, the fluid reservoir further comprising at least one baffle, each baffle being disposed within the internal volume and connected to an interior surface of the first flexible and translucent wall and an interior surface of the second flexible wall, the fluid reservoir including an opening disposed through the first flexible and translucent wall or the second flexible wall, the fluid reservoir being configured in shape and size such that the second flexible wall readily transfers body heat from a person using the hydration system to the internal volume;

a conduit for conveying fluid stored within the internal volume, wherein a first portion of the conduit is exterior to the fluid reservoir and a second portion of the conduit is disposed through the opening disposed through the first flexible and translucent wall or the second flexible wall and within the internal volume; and a pack for supporting the fluid reservoir in a position about an upper torso of the person using the hydration system, the pack comprising an insulative material on one of its sides for insulating the fluid reservoir from cold temperatures about an exterior surface of the first flexible and translucent wall, the pack further comprising a second non-insulative material on a second side for facilitating heat transfer from the upper torso of the person using the hydration system to the fluid reservoir, the pack further comprising at least one strap for snuggling the pack in close proximity to or near the upper torso of the person using the hydration system.

* * * * *